United States Patent [19]

Nakamura et al.

[11] 4,417,870

[45] Nov. 29, 1983

[54] LIQUID FUEL COMBUSTION APPARATUS

[75] Inventors: Shigeru Nakamura, Kamo; Yoshihiko Ueki, Niigata; Hiroshi Takachi, Muramatsu, all of Japan

[73] Assignee: Toshiba Heating Appliances Co., Ltd., Kamo, Japan

[21] Appl. No.: 298,895

[22] Filed: Sep. 2, 1981

[30] Foreign Application Priority Data

Sep. 10, 1980 [JP] Japan ..... 55-125451

[51] Int. Cl.[3] ..... F23Q 25/00

[52] U.S. Cl. ..... 431/33; 431/88; 431/301; 431/307; 431/315; 192/28; 192/33 R

[58] Field of Search ..... 431/304, 88, 33, 307, 431/317, 301, 18, 305, 306, 308, 315, 316, 318; 192/28, 33 R, 89 W, 46

[56] References Cited

U.S. PATENT DOCUMENTS

| | | | |
|---|---|---|---|
| 70,059 | 10/1867 | Wilber | 192/46 |
| 593,290 | 11/1897 | Bennett | 192/46 X |
| 1,585,019 | 5/1926 | Chadwick | 431/301 |
| 2,292,544 | 8/1942 | Pfeiffer | 192/28 |
| 2,502,859 | 4/1950 | Laxo | 192/33 R X |

FOREIGN PATENT DOCUMENTS

| | | | |
|---|---|---|---|
| 54-129535 | 10/1979 | Japan | 431/88 |
| 54-142630 | 11/1979 | Japan | 431/88 |
| 1,461,735 | 1/1977 | United Kingdom | 431/307 |

*Primary Examiner*—Samuel Scott
*Assistant Examiner*—Kenichi Okuno
*Attorney, Agent, or Firm*—Oblon, Fisher, Spivak, McClelland & Maier

[57] ABSTRACT

A liquid fuel combustion apparatus comprises a combustion cylinder for supporting a wick to be vertically movable between a combustion position and an extinguished position, a rotating shaft connected to said wick for raising and lowering said wick, a driving motor, rotational force transmitting mechanism for rotating the shaft in one direction to thereby raise the wick to the combustion position, the rotational force transmitting mechanism being automatically disengaged from said rotating shaft when the wick arrives at the combustion position, a spring charged with the rotational force in the other direction of the rotating shaft as a result of the rotation of the rotating shaft in the one direction, holding mechanism for preventing the rotation of the rotating shaft in the other direction by the spring so as to hold the wick in the combustion position, and releasing mechanism for releasing the holding operation of said holding mechanism.

10 Claims, 5 Drawing Figures

LIQUID FUEL COMBUSTION APPARATUS

BACKGROUND OF THE INVENTION

The present invention relates to a liquid fuel combustion apparatus wherein a rotating shaft is rotated by a driving motor to raise a wick connected to the rotating shaft, whereby the wick is brought to its ignition and combustion position.

Apparatuses of this type have been conventionally known wherein depression of an ignition button causes a driving motor to be rotated for a predetermined time to rotate a rotating shaft, whereby a wick is brought to an ignition and combustion position which is its uppermost position, while, similarly, the driving motor mentioned above is reversed upon depression of an extinguishing button for extinguishing the fire to return the wick to its lowermost or extinguished position. In a liquid fuel combustion apparatus of such an automatic wick shift type, raising and lowering of the wick can be carried out with a one-touch operation. Therefore, such an apparatus is more effective in that it is much easier to operate than apparatuses wherein the wick is raised or lowered by rotating a knob each time this is required.

However, the apparatuses of this type require the motor to be rotated in the forward and reverse directions. Additionally, high power is necessary to raise and lower the wick, so that the motor is expensive. Thus, such apparatuses have been defective because of their high cost. Furthermore, since the motor cannot be operated during a power failure or the like, it is entirely impossible to change the wick over from the combustion state to the extinguished state. This does not pose a serious problem in the case of ignition, but there have been problems in the case of extinguishment due to the possibility of dangerous accidents, because the motor cannot be driven when the power supply is stopped, even if, for example, an oscillation sensor employed for sensing earthquakes is triggered to control the motor drive. Therefore, apparatuses of this type are not practical at present, although they are easy to operate.

SUMMARY OF THE INVENTION

It is an object of the present invention to provide a liquid fuel combustion apparatus wherein a wick may be readily shifted without the possibility of causing a dangerous accident even when the power supply is stopped.

BRIEF DESCRIPTION OF THE DRAWINGS

FIG. 1 is a partially cut away plan view; FIG. 2 is a partially cut away side view; and FIG. 3 is a sectional view taken along the line A—A of FIG. 1; FIG. 4 shows a case in which a wick starts rising, and FIG. 5, a case in which its elevation is completed.

DETAILED DESCRIPTION OF THE PREFERRED EMBODIMENT

Figure 1:
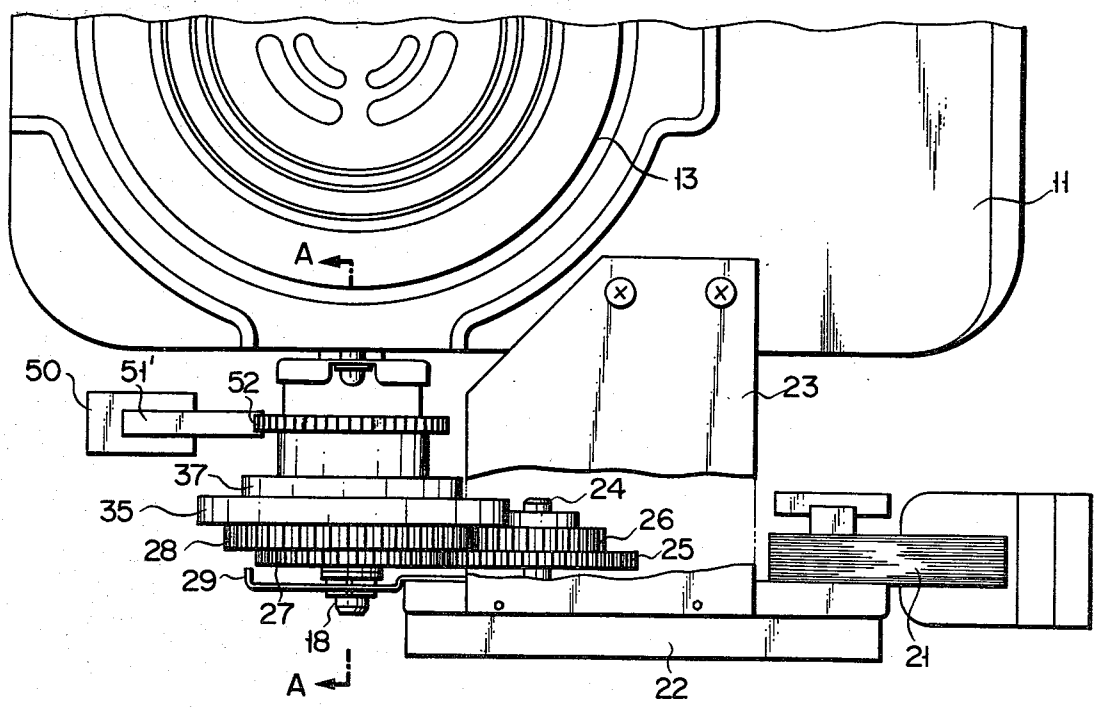
FIGS. 1 to 3 respectively show portions of a liquid fuel combustion apparatus according to one embodiment of the present invention.

One embodiment of the present invention will now be described below with reference to the accompanying drawings.

In the drawings, reference numeral 11 indicates a stationary tank, which is situated on a rest 12 and has on its upper portion a burner basket or outer combustion cylinder 13. A cylindrical wick guide or outer combustion cylinder 14 is formed coaxially in the burner basket 13 with a predetermined distance being provided between these two parts. A cylindrical wick 15 is attached around the outer circumference of this wick guide 14 such that the former can vertically move. The upper end of the wick 15 is constructed so as to emerge from or sink below a fire grate 13*a* provided at the upper portions of the burner basket 13 and the wick guide 14.

A wick holder 16 is engaged with the lower outer circumferential portion of the wick 15, and a rack 17 is mounted on the outer side portion of the wick holder 16. This rack 17 meshes with a pinion 19 which is fitted to the inner end portion of a rotating shaft 18 extending in the horizontal direction. Rotation of the rotating shaft 18 raises and lowers the wick 15 through the rack and the pinion.

Figure 2:
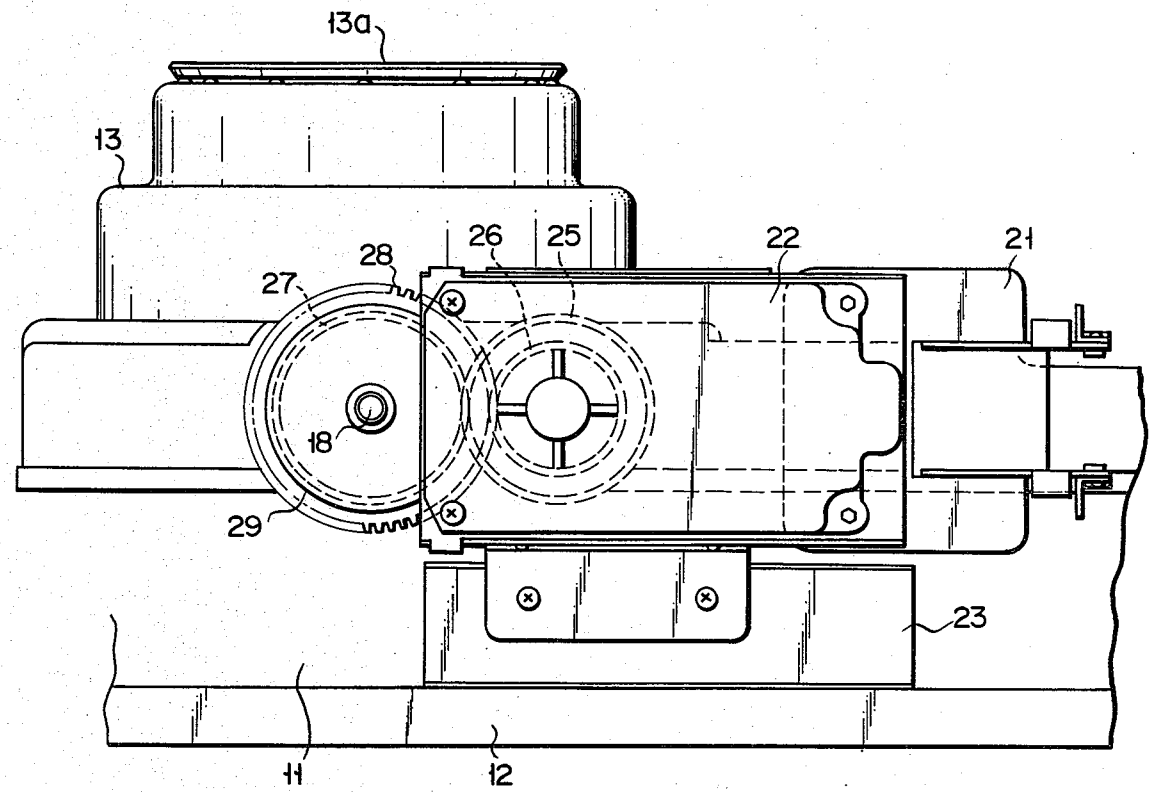
Figure 3:
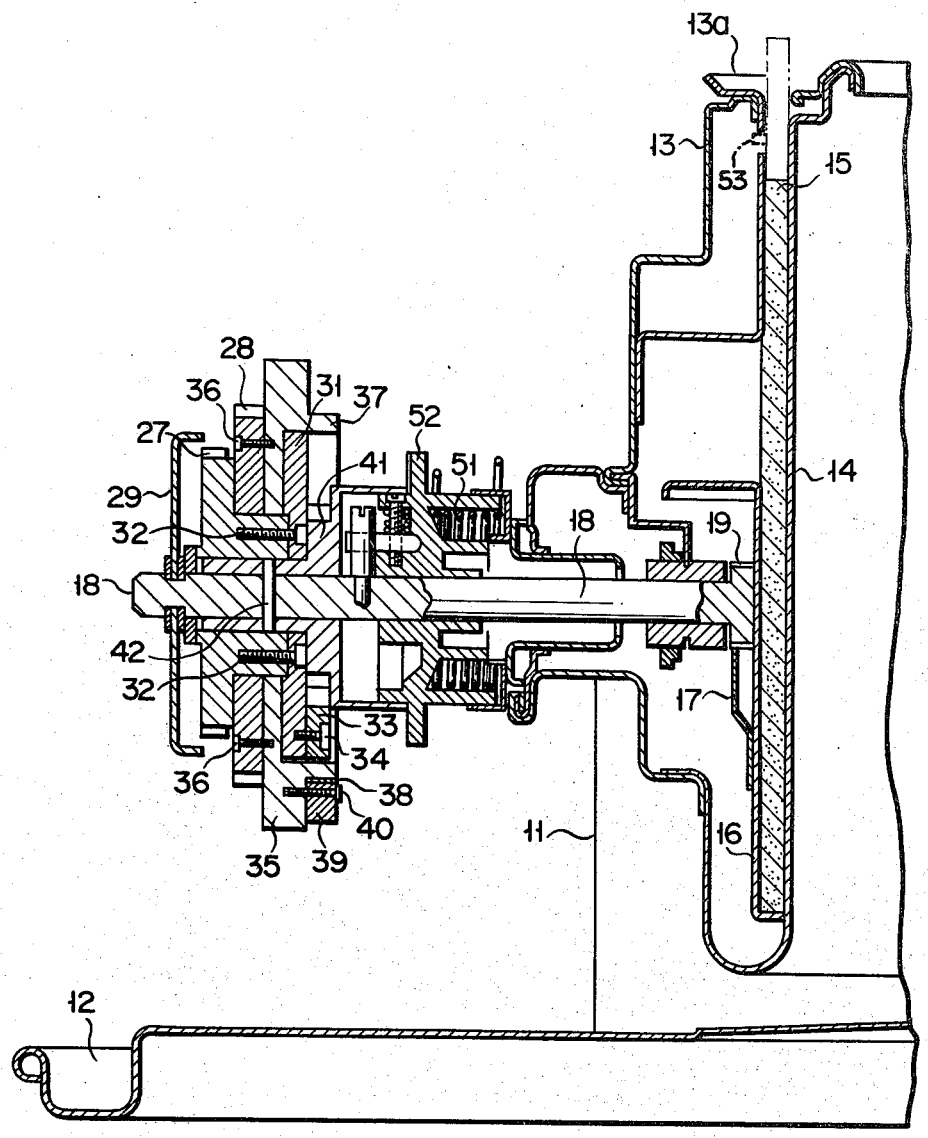

In FIGS. 1 and 2, reference numeral 21 indicates a gear motor which operates as a driving motor. This gear motor 21 and a gear case 22 formed integrally therewith are fixed to the stationary tank 11 via a mounting base 23. The output of the gear motor 21 is transmitted through a reduction gear train in the gear case 22 to an output shaft 24.

The output shaft 24 extends parallel to the rotating shaft 18, and a first output gear 25 and a second output gear 26 are coaxially arranged on and fixed to this shaft 24. These first and second output gears 25 and 26 respectively mesh with a first driven gear 27 and a second driven gear 28 which are mounted coaxially on the rotating shaft 18 and free from this shaft 18. The outer end portion of the rotating shaft 18 is rotatably supported by a support 29 fixed to the gear case 22.

On the inner surface of the first driven gear 27 is coaxially situated and attached by fastening pins 32 a clutch supporting disc 31 in such a manner that the disc 31 can rotate with the first driven gear 27. A clutch 33 is attached by a supporting shaft 34 on the inner surface of this clutch supporting disc 31 near the outer circumference thereof so as to be rotatable about an axis parallel to the rotating shaft 18.

The second driven gear 28 is interposed between the first driven gear 27 and the clutch supporting disc 31, and a clutch guiding disc 35 is coaxially mounted on the inner side portion of the second driven gear 28 by fastening pins 36.

On the inner side of the clutch guiding disc 35 near the outer circumference thereof, a guide edge portion 37 in the form of a ring having a notch 43 projects about the rotating shaft 18. The guide edge portion 37 acts as an outer circumferential guide for the outer circumferential side of the clutch 33. A clutch spring 38 formed as a worked spring, one end of which is bent to project in the direction of the rotating shaft 18 through a slot formed near one end of the guide edge portion 37 and the other end of which is fixed to the clutch guiding disc 35 by a pin 40, is provided along a part of the outer circumference of the guide edge portion 37.

Furthermore, a clutch cam 41 is attached on the rotating shaft 18 by a fastening pin 42 so as to be situated on the inner circumferential side of the guide edge portion 37 formed on the inner side of the clutch guiding disc 35 and to correspond to the inner circumferential side of the clutch 33. This clutch cam 41 rotates with the rotating shaft 18.

A ratchet plate 52 having a return coil spring 51 housed therein is provided on the rotating shaft 18 on the inner side of the clutch cam 41, that is, on the side of the stationary tank 11. One end of the return coil spring 51 is fixed to the ratchet plate 52 and the other end thereof is fixed to the projecting portion of the outer combustion cylinder 13, respectively. When the wick 15 is being raised by the rotation of the rotating shaft 18, the rotating force of the rotating shaft 18 is stored in the return coil spring 51, while the tooth spaces formed on the outer circumference of the ratchet plate 52 are engaged by a clutch pawl 51' of an oscillation sensor 50 shown in FIG. 1. After the force has been stored in the return coil spring 51, the force stored by the return coil spring 51 will cause the wick 15 to descend immediately if the clutch of the oscillation sensor 50 is released, whereby the fire is extinguished.

In such a construction, when the gear motor 21 is rotated by turning on a main switch (not shown), the output shaft 24 is rotated by the gears in the gear case 22 and the first and second output gears 25 and 26 which are coaxial with this shaft are also rotated, while the first and second driven gears 27 and 28 which respectively mesh with these gears 25 and 26 also start rotating.

With this rotation, the clutch supporting disc 31 and the clutch guiding disc 35 which are respectively integral with the first and second driven gears 27 and 28 are also rotated. At this point of time, the clutch 33 on the clutch supporting disc 31 and the clutch cam 41 fixed on the rotating shaft 18 do not mesh with each other. Therefore, the clutch supporting disc 31 and the clutch guiding disc 35 idle relative to the rotating shaft 18.

Figure 4:
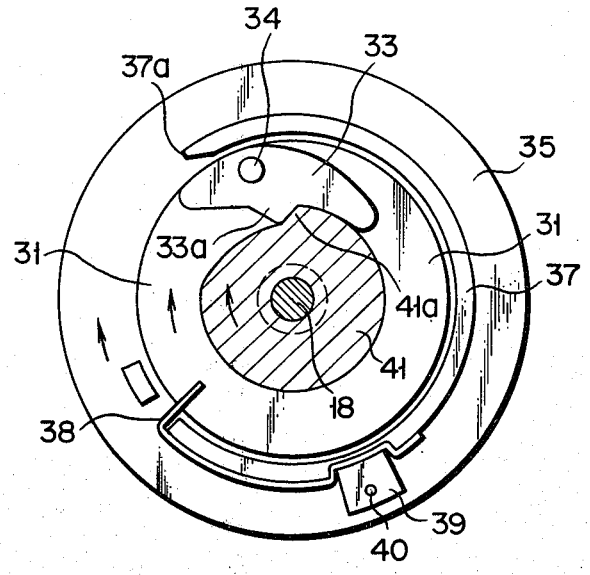
FIGS. 4 and 5 are, respectively, partially cut away views showing the relationship among a clutch cam, a cam and a guide edge portion of the same apparatus.

In this case, the first output gear 25 and the first driven gear 27 mesh with each other in a gear ratio of one to one, and the second output gear 26 and the second driven gear 28 mesh with each other in a gear ratio of one to two. Consequently, the rotational speed of the clutch supporting disc 31 is twice the rotational speed of the clutch guiding disc 35. The first output gear 25 and the first drive gear 27 are meshed such that the clutch 33 on the clutch supporting disc 31 starts rotating from its lowermost point, and the second output gear 26 and the second driven gear 28 are meshed such that the notch 43 also starts rotating from its lowermost point. Thus, while the clutch 33 rotates by 180 degrees to its uppermost point, the clutch guiding disc 35 rotates by 90 degrees, both then assuming the position shown in FIG. 4. During its rotation from its initial position to the position shown in FIG. 4, the clutch 33 is pivoted inwardly by an inclined end portion 37*a* formed on the guide edge portion 37, causing the clutch 33 to enter into the gap between the guide edge portion 37 and the clutch cam 41. The center of gravity of the clutch 33 is spaced from the supporting shaft 34 on the side adjacent the engageable portion 33*a* of the clutch 33, and further rotation of the clutch supporting disc 31 causes the engageable portion 33*a* of the clutch 33 to be forcibly engaged with an engageable portion 41*a* of the clutch cam 41 under the self-weight of the clutch 33. The rotating shaft 18 thereby starts rotating with the clutch supporting disc 31, with the result that the wick 15 starts rising due to the pinion 19 of the rotating shaft 18 meshing with the rack 17 of the wick holder 16.

Figure 5:
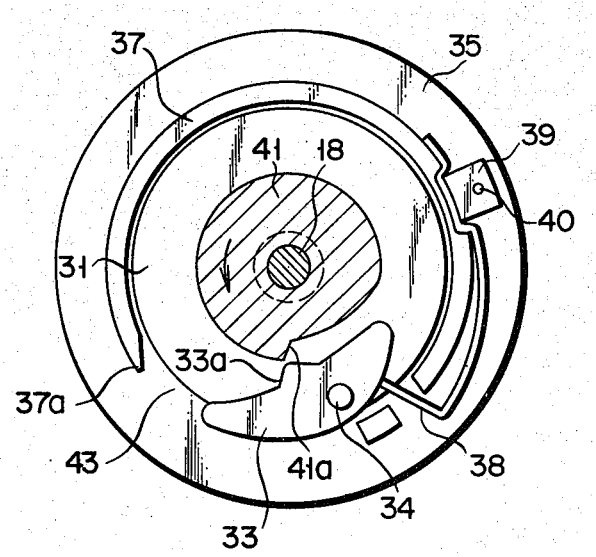

In this case, the number of revolutions of the rotating shaft 18, as determined by the relationship between the pinion 19 and the rack 17 of the wick holder 16, is set to be 1.5 from the time at which the wick 15 starts rising up to the time when the wick 15 completes its rising. When the wick 15 completes its rising, a microswitch or the like 53 detects its elevated position, and the gear motor 21 is stopped. As a consequence, the clutch 33, which engaged with the clutch cam 41 at its uppermost point, will have made one-and-a-half entire revolutions during the rising of the wick 15 and will be situated at its lowermost point, as shown in FIG. 5, when the gear motor 21 is stopped. That is, the number of revolutions of the cam 41 from the time when the main switch has been turned on will be two, and the number of revolutions of the guide edge portion 3 will be one. Therefore, from the relationship between the gear ratios described above, both the clutch 33 and the clutch guiding disc 35 stop in the same position that they occupied when the main switch was turned on.

Slightly before being stopped, the clutch 33, which rotates faster than the clutch guiding disc 35 due to the difference in gear ratios described above, overtakes and pushes up the end of the clutch spring 38 provided on the clutch guiding disc 35. When the end of the clutch spring 38 falls behind the position of the supporting shaft 34 (which functions as the fulcrum of the clutch 33), the end of the clutch 33 is situated in the notched portion 43 of the guide edge portion 37 of the clutch guiding disc 35, so the guide edge portion 37 cannot act to keep the clutch 33 in engagement with the clutch cam 41. At that point, the clutch spring 38 pushes up the rear end portion of the clutch 33, causing the disengagement of the clutch cam 41 and the clutch 33. Thus, at the same time that the uppermost elevated point of the wick 15 is detected by the microswitch or the like and the gear motor 21 is stopped, the clutch 33 is separated from the clutch cam 41. Accordingly, the clutch cam 41 will not contact the clutch 33 during the lowering of the wick 15.

Thereafter, release of the clutch of the oscillation sensor 50 engaging with the pawl of the ratchet plate 52 reversely rotates the rotating shaft 18 and the clutch cam 41 formed integrally therewith under the force of the return coil spring 51 stored during the rising operation of the wick 15, which causes the wick 15 to go down. Since the clutch cam 41 is separated from the clutch 33 in this case, the clutch cam 41 is reversely rotated without friction drag between itself and the clutch 33 to return to the position where the wick 15 starts rising. It should be particularly noted that the clutch cam 41 is returned to its predetermined starting point (shown in FIG. 4) by the meshing of the rack 17 and the pinion 19. That is, when the wick holder 16 is in its lowermost position, the clutch cam 41 is in the position shown in FIG. 4. As for the clutch 33 and the clutch guiding disc 35, the relationship between the gear ratios described above will allow the clutch 33 and the clutch guiding disc 35 to be situated also in the same positions they occupied when the main switch was turned on, which is the same position arrangement as in the initial condition.

According to the embodiment described above, the ratio of the rotational frequencies of the clutch supporting disc and the clutch guiding disc is selected to be a predetermined value, so that the clutch and the clutch cam can always engage with each other at the same point to enable steady rising of the wick. In addition, while the clutch is engaged with the clutch cam and the wick is rising, the clutch guiding disc, while rotating, always covers the outer circumference of the clutch and the other parts up to the time when the wick has completed its rising. Therefore, even if the switch is turned off to stop the driving motor before the engageable portions of the clutch and the clutch cam are situated at their lowermost points, the clutch and the clutch cam will never be disengaged. Consequently, the engagement therebetween will never be impaired. When the driving motor is again started afterward, the wick can be elevated without hindrance.

Once the clutch supporting disc and the clutch guiding disc have been set during assembly in their predetermined positions via the respective gears which transmit rotational force to the clutch supporting disc and the clutch guiding disc, it is ensured that the engagement of the clutch with the clutch cam can be released at the time when the wick has risen to its uppermost position. Accordingly, the reverse rotation of the rotating shaft during the extinguishing operation may be readily carried out.

What we claim is:

1. A liquid fuel combustion apparatus comprising:

(a) a wick holder;

(b) first means for vertically moving said wick holder between a raised combustion position and a lowered extinguished position, said means including a rotatable shaft;

(c) a driving motor;

(d) rotational force transmitting means operatively connecting said driving motor to said rotatable shaft for transmitting the rotational force of said driving motor to said rotatable shaft so as to rotate said rotatable shaft in a first direction, thereby moving said wick holder vertically from its lowered extinguished position to its raised combustion position, said rotational force transmitting means comprising:

(i) a clutch cam fixed on said rotatable shaft;

(ii) a clutch supporting disc operatively connected to said driving motor such that rotation of said driving motor causes rotation of said clutch supporting disc; and (iii) a clutch carried by said clutch supporting disc in position:

(A) to engage said clutch cam during rotation of said clutch supporting disc, thereby transmitting the rotational force of said driving motor to said rotatable shaft and causing said rotatable shaft to rotate in said first direction, and (B) to disengage from said clutch cam when said wick holder has reached its raised combustion position;

(e) second means for automatically disengaging said driving motor when said wick holder has reached its raised combustion position;

(f) a spring which is operatively connected to said rotatable shaft so as to be charged by the rotation of said rotatable shaft in said first direction and so as to rotate said rotatable shaft in the opposite direction upon discharge;

(g) holding means operatively connected to said rotational force transmitting means for preventing the rotation of said rotatable shaft in said opposite direction under the urging of said spring; and (h) releasing means for releasing said holding means, thereby permitting said wick holder to return to its lowered extinguished position under the urging of said spring.

2. A liquid fuel combustion apparatus as recited in claim 1 wherein said releasing means are manually actuable.

3. A liquid fuel combustion apparatus as recited in claim 2 and further comprising an oscillation sensor which is operatively connected to said releasing means to actuate said releasing means when said oscillation sensor senses an earthquake.

4. A liquid fuel combustion apparatus as recited in claim 1 wherein:

(a) said clutch supporting disc has a first position corresponding to the lowered extinguished position of said wick holder and (b) said clutch does not engage said clutch cam until after said clutch supporting disc has been rotated from its first position by a pre-determined amount.

5. A liquid fuel combustion apparatus as recited in claim 1 wherein:

(a) said rotatable shaft is horizontally disposed;

(b) said clutch supporting disc rotates about an axis which is coaxial with the axis of said rotatable shaft;

(c) said clutch is pivotably supported on said clutch supporting disc for pivotal movement about an axis spaced from the center of gravity of said clutch and from said rotatable shaft; and (d) the force of gravity causes said clutch to pivot into engagement with said clutch cam as said clutch rotates about said rotatable shaft.

6. A liquid fuel combustion apparatus as recited in claim 5 wherein said rotational force transmitting means further comprises:

(a) a clutch guiding disc mounted for rotation about an axis which is coaxial with the axis of said rotatable shaft, said clutch guiding disc being operatively connected to said driving motor such that rotation of said driving motor causes rotation of said clutch guiding disc, and (b) a clutch guide carried by said clutch guiding disc, said clutch guide being in the form of a ring which surrounds said clutch and acts as an outer circumferential guide for said clutch except where there is a notch in said clutch guide.

7. A liquid fuel combustion apparatus as recited in claim 6 wherein said rotational force transmitting means further comprise disengaging means for forcing said clutch out of engagement with said clutch cam when said wick holder has reached its raised combustion position.

8. A liquid fuel combustion apparatus as recited in claim 7 wherein:

(a) said clutch has a rear end portion which extends on the other side of the axis of said clutch from the portion of said clutch which engages said clutch cam and (b) said disengaging means comprises a spring one end of which is fixed to said clutch guiding disc and the other end of which is positioned to bear against said rear end portion of said clutch when said wick holder has reached its raised combustion position.

9. A liquid fuel combustion apparatus as recited in claim 7 wherein the initial positions of said clutch supporting disc and said clutch guiding disc and the ratio of the speed of revolution of said clutch supporting disc to the speed of revolution of said clutch guiding disc are determined such that said clutch and the notch in said clutch guide do not align with each other except when said wick holder has reached its raised combustion position.

10. A liquid fuel combustion apparatus as recited in claim 9 wherein the ratio of the speed of revolution of said clutch supporting disc to the speed of revolution of said clutch guiding disc is 2 to 1.

* * * * *